United States Patent [19]

Brouwer et al.

[11] Patent Number: 4,473,096

[45] Date of Patent: Sep. 25, 1984

[54] WEFT END RECEPTION SYSTEM

[75] Inventors: Charles W. Brouwer, East Greenwich; Larry C. Cowan, Saunderstown; David T. Guerin, Coventry, all of R.I.

[73] Assignee: Leesona Corporation, Warwick, R.I.

[21] Appl. No.: 63,717

[22] Filed: Aug. 6, 1979

[51] Int. Cl.[3] ..... D03D 49/60

[52] U.S. Cl. ..... 139/188 R; 139/194; 139/370.2; 139/435

[58] Field of Search ..... 139/429, 435, 450, 452, 139/194, 188 R, 370.1, 370.2

[56] References Cited

U.S. PATENT DOCUMENTS

| | | | |
|---|---|---|---|
| 2,519,786 | 8/1950 | Paabo | 139/435 |
| 3,441,059 | 4/1969 | Gotz et al. | 139/194 |
| 3,880,198 | 4/1975 | Jermeulen | 139/435 |
| 3,938,561 | 2/1976 | Scheffel | 139/435 |
| 4,023,599 | 5/1977 | Zeleny | 139/370.2 |

*Primary Examiner*—Henry Jaudon

*Attorney, Agent, or Firm*—Burnett W. Norton

[57] ABSTRACT

In a loom of the type in which a weft strand is projected in free flying fashion from one side of a warp shed to the opposite side thereof and which includes a lay rockable between a weft projecting position and a beat up position, a reed fixed on the lay for beating up the inserted weft strand into the fell of the fabric being woven when the lay moves to beat up position, and a strand reception tube carried on the lay for receiving the free end of the projected weft strand proximate to such opposite side, the improvement of a support for the reception tube which permits bodily pivotal displacement of the reception tube toward and away from the reed while pivoting with the lay.

17 Claims, 7 Drawing Figures

FIG. 2A.
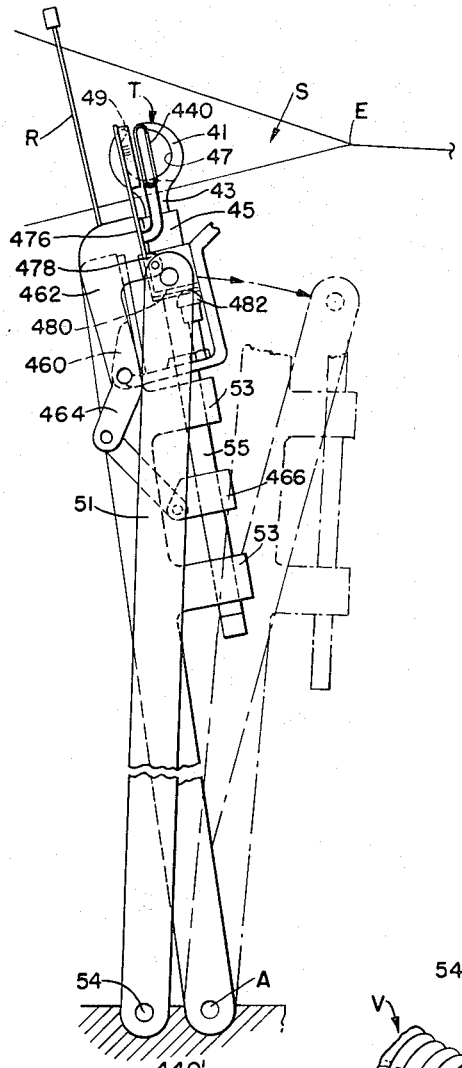
FIG. 2B
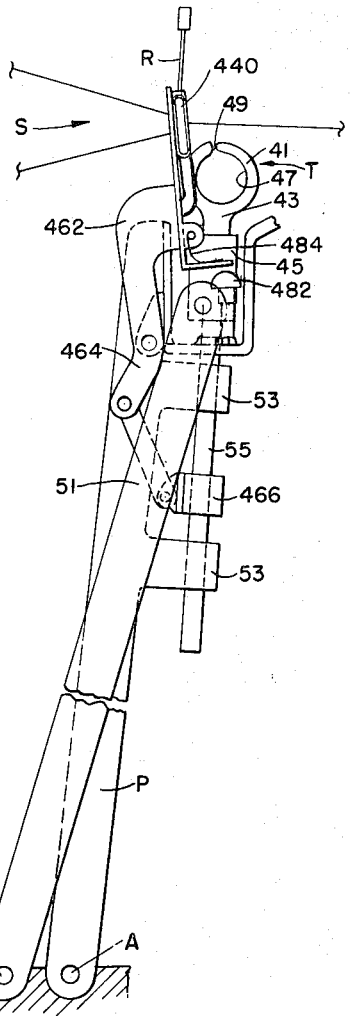
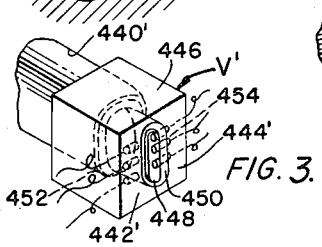
FIG. 3.
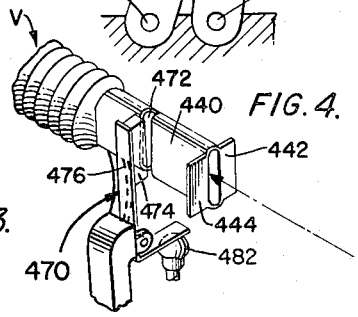
FIG. 4.

ELECTRIC CIRCUIT DIAGRAM

WEFT END RECEPTION SYSTEM

FIELD OF THE INVENTION

This invention relates to a loom weaving system in which the weft is inserted through the shed of the loom by means of a pulse-like jet of air or other pressurized gaseous medium (hereinafter referred to generally as an air weft insertion system) and is concerned more particularly with an improved weft strand end reception means mounted on the lay of the loom on the opposite side of the shed and pivoting bodily upon the lay toward and away from the reed while rocking with the lay during the weaving operation and including detecting means associated with the reception means for sensing the arrival of the weft strand end thereat and in the absence of such arrival activating a loom stop motion to terminate the weaving operation.

BACKGROUND OF THE INVENTION AND PRIOR PRACTICE

In all weaving, an initially flat array of longitudinally extending warp threads is divided into at least two interspersed groups which are separated in opposite directions from the starting plane to define between the separated warp groups an elongated diamond shaped space, known as a "shed", through which the weft or filling is inserted, the direction of separation of the warp groups being reversed in a given order after each such weft by means of a harness motion with the result that the warp threads are entwined in sinuous fashion around successive filling threads to form the woven fabric. Traditionally, the weft is carried in coiled form upon a bobbin held within a shuttle, and as the weaving progresses, the shuttle is propelled alternatively back and forth through the shed on the upper surface of a beam-like lay which carried a comb-like reed projecting upwardly therefrom and rocks back and forth to press or "beat up" each new weft by means of the reed against the working end or "fell" of the fabric being woven. In the traditional loom, bobbin propulsion was accomplished by means of so-called picker sticks mounted on the loom adjacent opposite side edges of the warp for pivotal movement about their lower ends and driven to alternately impact their upper ends against the shuttle. Obviously, this conventional design was subject to inherent limitations as to achievable shuttle speed and was, moreover, accompanied by substantial disadvantages; namely, deafening operating noise as well as risk of breakage of picker sticks or other damage to equipment and of danger to operating personnel when, as occasionally happened, the shuttle escaped its containment and became an uncontrolled projectile. In order to overcome these inherent problems in bobbin type weaving, the prior art has explored various alternatives, and in the past decade or so, increasing attention has been directed to the possibility of impelling the weft thread through the shed by means of a jet of fluid. Jets of water have been found to be a relatively manageable projection medium, but water is a possible cause of corrosion and limits the choice of yarn material; thus there are significant advantages in the use of a gaseous fluid. While gases other than air can in theory serve equally well, cost considerations dictate the choice of air as the only practical gaseous propelling medium; consequently, this mode of weaving will hereinafter be referred to for convenience as "air weft insertion", although the use instead of other gases is, in principle, intended to be included.

In general, air projection techniques that have been used in past air weft insertion systems fall into two basic categories. In one type, the weft end is initially projected by means of a pressurized air from a nozzle situated outside and adjacent one side of the warp shed which serves to initially accelerate the weft end and starts its travel through the shed. The propulsion forces of existing nozzles is severely limited in terms of the attainable length of projection of the weft end and hence, in this type, a plurality of "booster" or supplemental jet nozzles is provided at spaced intervals through the shed, such nozzles being inserted within and removed in various ways from the shed interior via the clearance between the warp yarns. The aggregate of the propulsion forces of this multi-stage sequence of nozzles can be sufficient to convey the weft thread across the full width of the loom.

While this approach has proved generally feasible in practice, it too is faced with definite disadvantages, viz, the requirement for carefully controlled timing of the sequence of nozzle action plus excessive consumption of compressed air and thus poor economic efficiency.

In order to avoid the need for booster nozzles disposed at intervals through the shed, an alternative approach has been developed in a second type which utilizes a single exterior insertion nozzle in conjunction with a weft guidance "tube" situated within the shed. Since during weaving, the groups of warp threads must shift up and down past one another, the presence of any continuous body within the shed during shedding is out of the question. Therefore, an "interrupted" weft guidance tube is used, taking the form of a plurality of generally annular segments, each shaped to sufficiently narrow thickness in its axial dimension as to pass between adjacent wrap threads arranged in an axially aligned position so as to constitute together a lengthwise interrupted tubular member extending substantially the entirety of the shed width. Each annular segment has a slot-like exit opening at a point on its periphery to allow lateral egress of the inserted weft thread when the guidance tube is withdrawn below the shed. When the weft thread is projected by the exterior nozzle into one end of this interrupted guidance tube, the projection force imparted to the thread by the nozzle appears to be substantially enhanced so that the distance the weft thread is propelled by this force can be significantly increased compared to the nozzle alone.

The reasons why the interrupted guidance tube extends the projection force of the nozzle are not totally understood at present. The adjacent segments of this tube are separated by clearance spaces which are sufficient to permit pressurized air delivered into one end of the tube to disperse to the outside atmosphere while the interior edges of the bore of the segments should present considerable frictional resistance to movement of an air jet therethrough; from this standpoint the effect of such a tube might be expected to be negative. On the other hand, ambient air could be entrained from the ambient atmosphere into the interior of the tube through the same intersegment spaces with the possible effect of augmenting the propelling forces. In any event, it is established that the addition of a weft guidance tube generally as described above substantially increases the distance a weft thread can be projected with a jet of compressed air emitted from a nozzle and is virtually indispensable if the weft thread is to be effectively projected across the width of any practical size loom, say 48 inch or more in width.

Obviously, unless the leading end of the weft strand is projected entirely across the width of the loom with at least a short leading end portion protruding outside the opposite side of the shed, then there will result a defect in the fabric unless such nonarrival of the strand is detected virtually instantaneously and the weaving operation immediately terminated so as to allow the misdirected weft end to be corrected before the weaving operation is re-commenced. In order to assist the leading weft strand end in reaching the opposite shed side, it is fairly common practice in the weft insertion art to equip the loom with a means disposed adjacent the opposite side of the shed for attracting the leading strand end therein and, typically, such means takes the form of vacuum or suction tube having its opening facing the opposite shed side so as to aspirate the strand end therein. This kind of reception means is adapted readily to the detection of the arrival of the strand end by means of photoelectric or other strand sensing devices incorporated within the suction tube.

While these prior art arrangements have in principle proved advantageous, there is need in the art for further improvement, especially in terms of simplification of the necessary hardware, adaptation of the reception means to compensate for the varying position of the weft strand relative to the reed of the loom between the weft insertion and beat up positions of the reed, and enhancement of the durability and reliability of activation of the loom stop motion in the event of nonarrival of the weft strand.

SUMMARY OF THE INVENTION

In accordance with the present invention, a weft end reception means, preferably in the form of a vacuum or suction tube is mounted on the lay of the loom for bodily rocking movement, by way of a pivotable support permitting individual bodily pivotal movement of the reception means, and lever means are provided to cause the pivotal means to pivot during the rocking motion of the lay to move the reception means away from and towards the reed as the lay moves to and from beat up and weft insertion positions. Associated with the reception means is a sensing unit, such as a photoelectric sensor, and preferably an array of photoelectric emitter-transducer units, which are effective to indicate the arrival of the weft strand end within the reception means. An electrical circuit is provided which is effective to activate the loom stop motion unless the indication of the sensing means is delivered thereto and such electrical circuit means is energized to receive such indication only during a predetermined interval of the operating cycle of the loom by timing means operated cylically in response to the loom operating cycle.

STATEMENT OF OBJECTS

An object of the present invention is an improved support for the weft reception tube which automatically adjusts the position of that tube to maintain the same in registration with the path of the weft throughout the weaving cycle.

Another object of the present invention is an improved weft arrival detection means which is electrically coupled to a stop motion of the loom so as to reliably cause the activation of such stop motion if the weft strand should fail to arrive at the reception means.

These and other objects and advantages will be explained in greater detail by the following detailed description when read in conjunction with the accompanying drawings in which:

BRIEF DESCRIPTION OF THE DRAWINGS

These and other objects and advantages will be more fully explained by the following complete description when read in conjunction with the accompanying drawings in which:

FIGS. 2A and 2B are enlarged detail views looking at the left end of the lay of the loom of FIG. 1 in rearward weft inserting position and forward beat up position, respectively, showing the compound motion of the weft guidance tube;

FIG. 3 is a detail view of one form of weft reception tube with an associated weft engaging clamp;

FIG. 4 is a detail view of a modified weft reception tube incorporating photoelectric detection devices for signalling the arrival of the weft end;

GENERAL DESCRIPTION OF SYSTEM OF INVENTION

The strand delivery system of the present invention is preferably utilized in the context of an overall loom which is described in general terms in the following summary. For further details as to the specific features which are embodied in the loom reference may be had to U.S. Pat. No. 4,347,872, issued Sept. 7, 1982, the subject matter of which not contained in this disclosure being herewith incorporated by reference.

Figure 1:
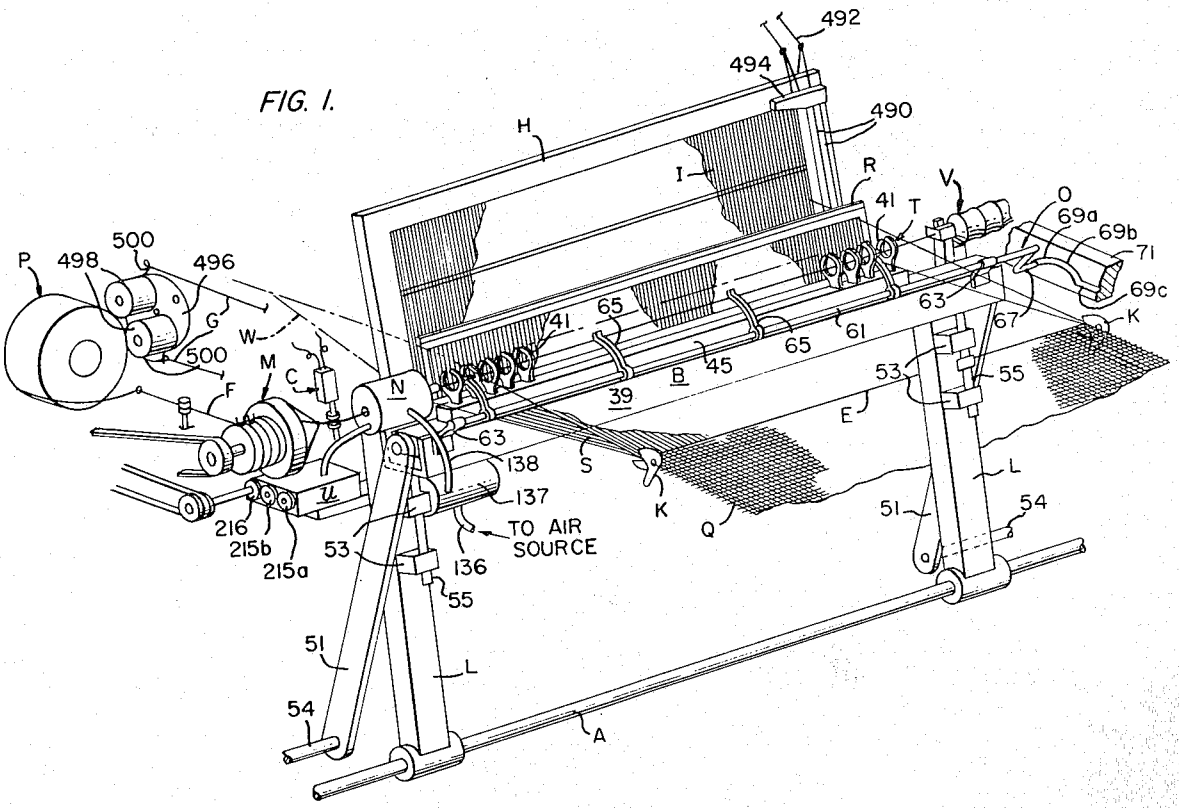
FIG. 1 is a highly schematic view in perspective of the essential components of a loom incorporating the present invention.

The loom of the present invention is basically conventional in much of its construction and operation (with one adaptation to better suit the requirements here), and the loom structure is illustrated schematically in an overall view in FIG. 1 and described generally with alphabetical designation only in enough detail to establish the context of the present improvements. As usual, the warp threads on ends W are carried on a rotatably supported warp beam (not seen) and pass therefrom through the eyes of parallel arrays of heddle wires I arranged in two or more separate groups held in adjacent parallel planes by corresponding heddle frames H. The heddles frames H are mounted for alternating up and down reciprocation whereby the groups of warp threads are separated to form an elongated diamond-shaped shed S having its front corner defined by the fell E of the fabric being woven. Forwardly of the heddle frames H, a lay beam B extends withwise across and beneath the lower plane of the warp, the lay beam B being mounted at its ends on generally upstanding supports or swords L which are pivoted on a shaft A at their lower ends and are rocked to and fro by driving means, such as a crankshaft, not shown. A reed R in the form of a sheet-like array of wires on the flat plates with the warp threads passing in the clearance space therebetween projects upwardly from the rear side of the lay beam to impress each new weft against the fell as the lay beam rocks forwardly. The woven fabric is collected in a conventional way upon a take-up beam, not shown.

The fabric has a rough or fringe selvage Q because the weft is inserted in the warp shed continuously from the same side of the warp shed rather than alternately from opposite sides as in conventional shuttle weaving. This rough selvage may be trimmed by means of trimming shears or knives K in operative position at the fell line and actuated in the usual way.

In accordance with the invention, the lay beam B of the loom is equipped with an interrupted segmental weft guidance tube to facilitate in a manner known in itself the delivery of weft or filling strands F through the shed, the guidance tube obtruding in interdigitating fashion with the warp ends into the interior of the shed when the lay beam is in its rearmost position and withdrawing from the shed while the lay beam moves forward. The lay beam preferably carries a weft lift-out device generally designated O to positively displace the inserted weft F from the guidance tube. The weft is projected into the interrupted guidance tube by means of a burst or pulse of air emitted by a weft insertion nozzle N mounted on the lay beam adjacent one side of the shed, while the free end of the inserted weft is received beyond the far side of the shed within a vacuum reception tube V carried on the opposite end of the lay beam and if desired is engaged by a clamp (not seen in FIG. 1) associated with that tube. Preferably, the tube is displaceably supported to follow the path of the weft during beat up. The reception tube can include photoelectric detection means (not seen) to detect the arrival of the weft thereat and initiate a control signal in the absence of the weft. The generation of the pulse or burst of air through the nozzle is precisely controlled by means of a nozzle activation control unit U which is actuated in timed relation to the cyclical operation of the loom. A proper length of weft is withdrawn from a weft package or other source P and made available to the insertion nozzle N by means of a strand metering and delivering unit M disposed at a fixed position outboard of the insertion nozzle N, and a clamping means C is interposed between the metering unit M and nozzle N for positively gripping the weft F in timed relation to the inserting action.

DETAILED DESCRIPTION OF INVENTION

The improved weft reception and stop motion activating means of the present invention is preferably employed in the context of an overall improved weft insertion system embodying a number of other advantageous features which are described individually in the following detailed explanation together with the details of the weft reception and stop motion activating means itself.

In a conventional loom, the lay beam consists of a large massive solid beam extending entirely across the width of the loom, the upper surface of the beam lying when in rearward weft insertion position virtually coplanar with the threads forming the lower side or floor of the shed whereby the shuttle can slide on the beam when moving through the shed.

In the loom of the present invention, the lay beam's massiveness is expendable, and only enough of a skeleton beam is retained, e.g. in the form of an upwardly opening channel 39 fixed to the ends of lay swords L, as required for the mechanical support of various components including the segmented or interrupted weft guidance tube T of the invention. As mentioned, this tube T consists of an axially aligned array of thin annular segments 41 (better seen in FIGS. 2A and 2B) which preferably have an axial thickness not greater than about $\frac{1}{8}''$ to allow their introduction upwardly into the interior of the shed S through the clearance spaces between warp threads W without abrading or otherwise damaging the warp and an annular thickness appropriate for mechanical strength, say $\frac{1}{4}$–$\frac{3}{8}''$. Each tube segment 41 has a radial foot-like extension 43 projecting from a lower peripheral point to enable the elements to be mounted in spaced axially aligned relation upon a transversely extending common base 45 in which the extension ends 43 are fastened or embedded. Each weft thread F during insertion is projected through the interior bore 47 of predetermined diameter of the axial array of the annular segments 41 and provision is made for the escape of the weft thread laterally from the segment array as it is withdrawn from the shed, by way of a narrow gap 49 formed in each segment at a common peripheral point on the rear upper quadrant thereof.

In prior art constructions, the interrupted guidance tube is fixed relative to the lay. Obviously, the guidance tube elements must, in any case, be completely withdrawn from the interior of the shed S before the reed R reaches beat up position to permit the weft F to float free within the shed before being pressed against the fell E of the fabric by the forward motion of the reed R. In general, prior art arrangements have usually required some change in the normal arcuate path of the lay beam so as to achieve a timely withdrawal of the guidance tube, for example, by tilting the lay beam and reed bodily forwardly toward the fell of the fabric. This results, however, in the reed having a considerable inclination at its beat up position which means that the force driving the thread against the fabric fell E is applied at an angle to the plane of the fell, displacing the thread downwardly at the same time as it is pressed forwardly against the fell, which can lead to distortions in the fabric, whereas in conventional loom design, the arcuate path of the lay beam is more or less symmetrical about a vertical plane so as to give the best compromise between the preferably horizontal position of the lay during weft insertion and the preferably vertical position of the reed at beat up position.

In the present invention, the lay beam construction is modified to incorporate a mounting permitting relative vertical displacement of the weft insertion tube. The design of the mounting is not critical and can take various forms. For example, each lay sword can be provided with a vertically spaced pair of collars 53 in axial alignment for sliding reception of a slide rod 55 passing through openings in the bottom of channel 39 (FIG. 1) and attached at its upper end to the supporting base 45 of insertion tube T. The ends of the base 45 are connected to the upper ends of generally upstanding driving links 51 which are pivoted at their lower ends to the frame of the loom on a pivot axis 54 displaced rearwardly from the pivot axis A of the lay swords L. Consequently, when the lay beam pivots, the upper ends of drive links 51 swing through a more inclined arc indicated by dashed arrows than the upper ends of the lay swords L creating a vertical displacement of the guidance tube base 45, and thus of the guidance tube T itself, relative to the lay beam channel 39. In this way, during beat up the guidance tube T has a compound motion, swinging arcuately with the lay beam while moving vertically by itself, and the point of its full withdrawal from the shed can, therefore, be varied as desired independently of the position of the lay beam B by adjusting the position of the lower pivot axis 54 of the drive links 51 relative to the pivot axis A of the lay swords L.

Early withdrawal of guidance tube T during beat up is advantageous in giving greater opportunity for the warp threads to recover from any distortion in their normal position as a consequence of the removal of the guidance tube segments 41 from therebetween. It has been found that if the tube is fixed relative to the lay beam and its withdrawal is thus delayed, the warp threads (which must shift laterally somewhat to allow passage of the guidance tube segments) may be held in such displaced position at the time the weft is pressed against the fabric fell and become "locked" in this aberrant position when the shed collapses during reversal of the warp thread groups of the shed. This results in observable defects in the uniform spacing of the warp threads within the resultant fabric, producing what is known as a "reedy" fabric, because such defects are normally characteristic of excessively thick reed elements.

In selecting the position of the exit slot or gap 49 (FIGS. 2A and 2B) in the guidance tube segments 41 along the upper peripheral portion thereof, consideration should preferably be given to the compound motion of guidance tube T, including both the vertical component as well as the usual arcuate component. Thus, the less the vertical displacement of the guidance tube, the closer the position of exit slot 49 to the lower end of the upper segment quadrant adjacent reed R and vice versa.

In the embodiment of the loom of the invention illustrated in the drawings, the weft insertion nozzle N is mounted on the lay beam channel 39 in a fixed or stationary position and does not move in synchronism with the compound motion of the weft guidance tube. This permits a simplified construction and the effectiveness of the tube for weft insertion is not thereby significantly reduced. During the actual weft insertion phase, the vertical movement of the tube is virtually nil, and the axis of the insertion nozzle is aligned, well enough within the axis of the guidance tube over this phase. If desired, however, insertion nozzle N could likewise be mounted on the movable supporting base 45 for the weft guidance tube so that the axis of the nozzle would actually "track" the center line of the guidance tube over the complete operating cycle of the loom. Conceivably, this arrangement might afford some slight additional increase in overall operating speed in permitting the weft insertion phase to be initiated at a slightly earlier point in the cycle.

In order to insure that the leading end of the weft after insertion through the shed is engaged and contained during beat up of the weft, a hollow weft reception vacuum tube generally designated V is mounted on the end of the lay beam opposite the insertion nozzle, the tube being open at one end located adjacent to and facing that side of the shed and connected at its other end to a source of vacuum (not shown) maintaining a negative pressure in the tube of about 20" water. One preferred embodiment of vacuum tube V is shown in FIG. 3 and in this embodiment the end of the tube adjacent the shed is elongated or flattened as at 440 (see also FIGS. 2A and B) in a generally vertical direction parallel to the plane of the reed R to concentrate the suction force. To reduce the possibility of the leading weft end missing this slot-like opening having a width of about ⅜", a laterally projecting flange or baffle 442, 444 extends from either side of the opening to increase the "target area" of the opening. The effect of these flanges is to momentarily halt the movement of the weft end if it should miss the tube opening, which is enough for the suction in the tube end to attract the weft end therein.

It is advantageous for the arrival of the weft at the reception tube to be positively detected. In the event the weft end does not completely traverse the shed, which can occur when the weft end becomes entangled upon itself, the result is a defect in the woven fabric which can become permanent if weaving is continued. To this end, a photoelectric detection unit can be provided at the reception side of the shed and is preferably associated with a modified form of reception tube V' seen in FIG. 4. In this embodiment, the tube itself is circular as at 440' and telescoped over its open end is an enlarged collar 446 of generally oval or rectangular shape having a vertically elongated aperture 448 in its center communicating with the suction tube and defining the weft entry slot. The sides 442', 444' of the end face of the collar serve as the weft intercepting flanges, and the edge around the inlet opening can usefully be beveled or rounded as at 450 to further assist entry of the weft end. Integrated into the collar is a vertically spaced array of minute photoelectric beam generators 452 and associated transducers 454 disposed along opposite sides of the elongated entry slot at a plurality, say three, of vertically spaced points. The response of such a multi-cell array is more reliable than a single large cell, the minute cells being more sensitive to interception by a small thread while the multiplication of the cells increases the likelihood of the weft being detected. As will be described more fully in connection with the electrical circuit diagram of FIG. 5, the outputs of the photoelectric detection transducer are amplified and transmitted through an appropriate circuit to a solenoid-operated clutch (not shown) controlling the power transmission from the loom motor to the loom crankshaft to bring the loom automatically to a halt in the event a signal pulse from one or more cells indicating the arrival of the weft fails to be received within a set interval of the loom operating cycle. That interval can vary but preferably begins when the shed opens to the extent permitting weft insertion, i.e. at about 140° of the cycle, and terminates at the front dead center position of the loom with the lay beam in its full beat up position, i.e. at 360°. This interval can be established by means of switches and activated from the loom crankshaft at the appropriate points of its rotation.

As is evident from the end view of the reception vacuum tube 440, 440' seen in FIG. 2A, the axis of the 440, 440' during weft insertion must be generally in registration with the axis of the interrupted weft guidance tube T within the open shed S, which axis is necessarily spaced forwardly of the plane of the reed R. Hence, if the reception tube remained fixed in this position during beat up, its axis would lie forwardly of the fell of the fabric (which coincides with the plane of the reed at front dead center) and since the free length of weft projecting outside the shed is made as short as possible, say 1 to 1½" so as to minimize the waste resulting when such projecting lengths are eventually sheared from the fabric, and the fed weft ends could consequently be pulled out of the reception tube inlet as the lay beam approaches front dead center, this would result in loss of engagement with the free weft end at the very moment such end needs to be positively restrained for purposes of selvage formation.

Preferably, therefore, the reception tube is mounted for limited independent relative displacement upon the lay beam as appears in FIGS. 2A and 2B. To this end, a bracket 460 is affixed to one end of the lay beam and upon this bracket is pivoted a generally vertically arranged bell crank lever 462 carrying the suction tube 440 at its upper end. The lower end 464 of the bell crank lever is linked to a collar 466 fixed to one of the guide rods 55 forming part of the vertically displaceable support for the interrupted weft guidance tube T. Thus, as the lay beam rocks rearwardly and guide rods slide upwardly to introduce the weft guidance tube into the opening shed preparatory to the weft insertion, collar 466 also moves upwardly to rock bell crank 462 forwardly and bring the suction tube 440 into alignment with the guidance tube axis. Contrariwise, as the lay beam swings forward to beat up position and the weft guidance tube is withdrawn downwardly below the shed, the bell crank 462 is rocked rearwardly to displace the suction tube axis rearwardly of the guidance tube axis and into coincidence with the plane of the reed which is possible since the suction tube is located outside the end of the reed. Any lateral offset between the location of the collar 466 and the bell crank 462 can be bridged by extending one or more pivot shafts.

For some purposes, the engagement of the weft free end by the suction in the weft reception tube is desirably augmented by means of a positively activating weft end clamp 470 (see FIGS. 3, 2A and 2B). Such a clamp can be built into the reception tube by cutting a slot in one side of the tube 440, as at 472, for the projection therein of a weft clamping pad 474 carried at the upper end of an upstanding finger 476. Finger 476 is pivotally mounted at its lower end 478 to the bell crank 462 so as to be movable bodily with the bell crank and the reception tube 440 carried thereby while also capable of limited independent pivotal movement. Below the pivot point the finger includes an angularly forward extension 480 which is adapted to engage an adjustable fixed stop 482 anchored on the floor of the lay beam when the bell crank 462 is in forward position (and the lay beam is in rearward position) during weft insertion, thereby swinging the clamping pad 474 out of the tube slot 472 and allowing the weft end to freely enter the reception tube opening. Then, when the bell crank 462 pivots rearwardly during beat up, finger 476 rocks with it which lifts extension 480 away from the stop 482, allowing finger 476 to be biased forwardly by a spring 484 toward the reception tube seat 472 to bring pad 474 into engagement with the inside wall of the tube with the weft end gripped therebetween.

Figure 5:
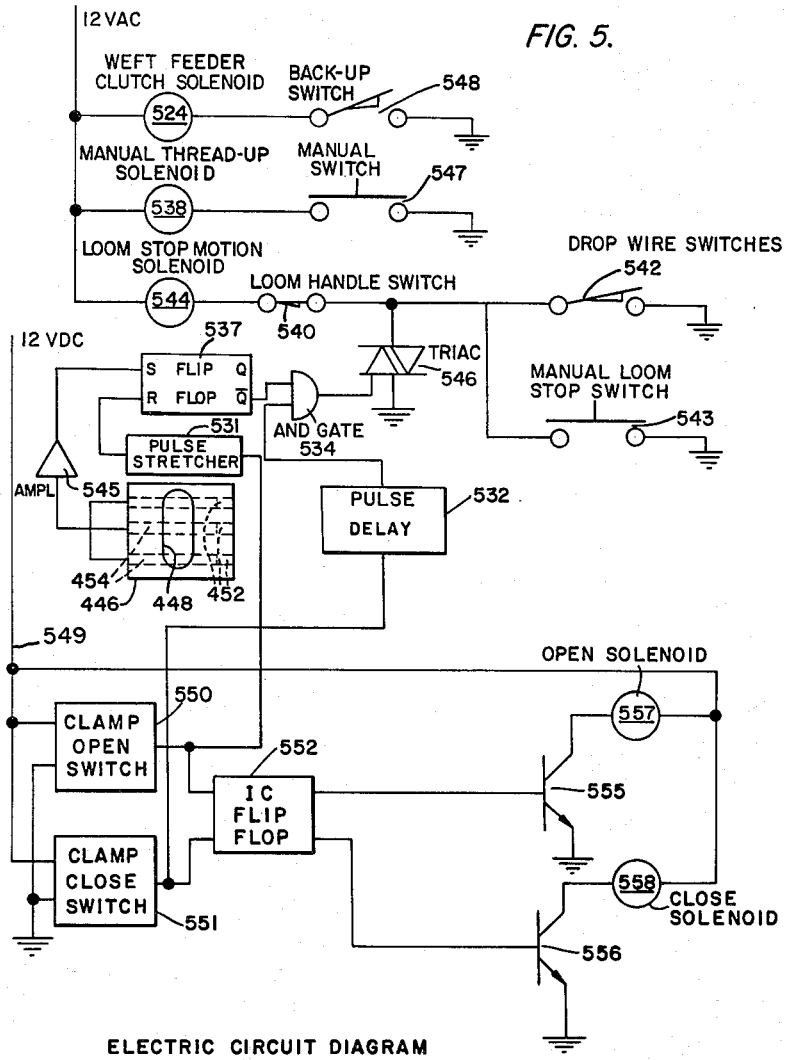
FIG. 5 is a schematic electrical circuit diagram for a preferred embodiment of the invention.

An electrical circuit diagram for the electrical components of the invention is seen in FIG. 5.

As already mentioned, it is possible to operate the weft delivery clamp by a spring-return solenoid energized by a microswitch contacted by a rotary cam rotating with the loom crankshaft and contoured to open and close the switch and thus the clamp at the proper times. Obviously, however, it would be complicated to adjust these times with such an arrangement. It is preferred, therefore, to operate the weft delivery clamp with two separate oppositely driving solenoids which are coupled together and to the clamp head and are energized alternately in correctly timed relation. To this end, as shown at the bottom of FIG. 5, separate clamp opening and clamp closing switches 550 and 551 are each connected on one side to a 12 volt D.C. line 549 and on the other side to a different side of an integrated circuit flip-flop 552. Each of the outputs of the flip-flop is connected to the base of an associated power transistor 555, 556 is connected in series to one side of a corresponding solenoid 557, 558 having its other side connected to the D.C. line 549 to complete the circuit. When the clamp open switch 550 is closed, transistor 555 is activated to permit current to flow through solenoid 557 to open the weft delivery clamp; while, conversely, when clamp closing switch 551 is closed, transistor 556 is activated to allow current to flow to the solenoid 558 to close the weft delivery clamp.

Figure 6:
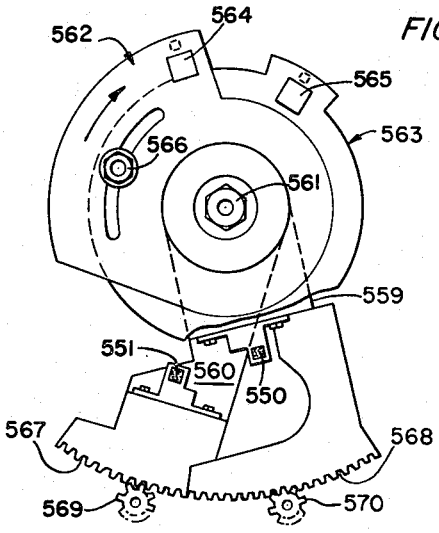
FIG. 6 is a detail view of a mechanical arrangement for actuating the clamp open and close switches permitting precise adjustment of the actuation times thereof.

A preferred arrangement for operating switches 550, 551 appears in FIG. 6 wherein switches 550, 551 take the form of Hall effect switches mounted at radially separated points on corresponding arms 559, 560 pivoted on a shaft 561 rotating with the loom crankshaft. Magnetic actuators 564, 565 are carried on separate discs 562, 563, fixed to the shaft 561 for rotation therewith, at corresponding radially separated points so that each of the actuators rotates in a circular path coinciding with only one Hall effect switch.

As stated, close control, within 1–2 ms, of the actuation of the weft delivery clamp can be important, and the open interval of the weft delivery clamp must be adjustable. Gross adjustment of the relative positions of magnetic actuators 564, 565 is possible by means of a clampable pin and slot connection 566. In addition, fine adjustment is achieved by forming the ends of the arms 559, 560 as gear segments as at 567, 568, for engagement with pinions 569, 570 fixed on the frame of the loom and secured by spring-biased detents (not shown) in any rotation position. The arms pivot independently on shaft 561 and by turning the pinions 569, 570, the relative peripheral positions of the arms and thus of the Hall effect switches themselves can be precisely adjusted.

A loom normally incorporates a so-called loom stop motion connected between a 12 volt A.C. source and ground and including a mercury switch 540 asociated with the operating position (being shown normally closed in FIG. 21). A drop wire switch 542 responsive to the warp drop wires (not shown) to be closed when a warp thread breaks is connected in parallel to a manual loom stop switch 543, and both are in series through switch 540 with the loom "stop" solenoid 544 controlling a clutch (not shown) transmitting power from the loom motor to the loom crankshaft so as to automatically stop the loom when any warp strand breaks during operation or manual stop switch 543 is closed. This circuit is conveniently used in the present invention for stopping the loom in the event the photoelectric weft detector array in the reception tube fails to detect the arrival of the leading weft end at the proper time. To this end, the output of a triac or bi-directional thyristor 546 is also connected in series with the stop solenoid 544 through the mercury switch 540, being in parallel with the drop wire switch 542 and the manual stop switch 543. The output of photodetector, emitter-transducer array 452, 454 (FIG. 19) is amplified for practical reasons by an operational amplifier 545 and applied to the S input of an RS flip-flop 537 having its Q output open and its $\overline{Q}$ output connected to one side of an AND gate 534. A resetting pulse is derived from the clamp open switch 550 and after being stretched in a pulse stretcher 531 is applied to the R input of flip-flop 547, the duration of the stretching extending until a few ms after front dead center of the loom. A timing pulse derived from the clamp close switch 551 is delivered to the other side of AND gate 534 after being delayed as at 532 so that its arrival coincides exactly with front dead center of the loom. The output of AND gate 534 is applied to the trigger of triac 546.

Unless interrupted by the arrival of the weft, the photoelectric array is continuously conducting and the S input of the flip-flop remains at logic 1 which holds the $\overline{Q}$ output at logic 1 and the Q output at logic 0. Thus, if no weft has arrived by the time the loom reaches front dead center, both inputs of the AND gate are at logic 1 and a pulse is passed by that gate to trigger the triac and actuate the stop motion solenoid. If a weft does arrive, a momentary logic 0 is received at input S which activates the flip-flop to make $\overline{Q}$ go to logic 0 and Q go to logic 1. Since the pulse stretcher 531 holds input R at logic 1 until after front dead center, the flip-flop holds $\overline{Q}$ at logic 0 irrespective of subsequent fluctuations of the R input between logic 1 and logic 0. Upon the termination of the stretched reset pulse, input S returns to logic 0 which resets the flip-flop to make $\overline{Q}$ go to logic 1 and Q go to logic 0.

The operation of the circuit of FIG. 5 will be facilitated by the following description. In the invention, it is desired to create an operating "window" or interval during which the possibility of the arrival of the weft strand exists and outside of which the detection means is deactivated so that any stray interruptions in the detection light beam during a time outside the portion of the operating cycle during which the weft end is actually being inserted is precluded. Furthermore, it is at least desirable if not necessary to disable the activating circuit from the oscillating or hunting effect that would be caused by repeated interruptions of the detector emitter-transducer array output by a fluttering weft end. To this end, a memory unit in in the form of the RS flip-flop 537 is provided for delivery thereto of the continuous output of the amplified emitter-transducer signal so as to sense and "remember" the arrival thereat of any interruption in the detector signal and thereafter remain inactive to the arrival of further such interruptions.

The memory device, however, is not read continuously but only at the last possible moment when the weft could be in proper position for continued weaving which, according to the present invention, is when the lay beam is in the front dead center position. Obviously, if the weft strand is not already entirely across the shed by the time the lay beam reaches front dead center, then a mispick has occurred and the loom needs to be stopped to permit repairs to be made. Therefore, a timing pulse is derived from the switch 551 which closes the weft insertion clamp at the end of the weft insertion stage but since switch 551 is actually closed somewhat before front dead center, it becomes necessary to delay the pulse generated by the closure of switch 551 for that period needed to correspond with front dead center, and a pulse delay unit 532 is added for this purpose. After being delayed at delay 532, the timing pulse arrives at the moment of front dead center and is gated in AND gate 534 with the output from the memory device 537. As known, an AND gate transmits a signal when both of its inputs are at logic state 1, and this gate output pulse is applied to the trigger of the triac. Thus, if an output appears from the memory device, as a logic 1, and is applied to one input of the gate 534, the arrival of the timing pulse places the other input of that gate in a logic 1 state so that the triac is triggered and the loom stop motion solenoid is activated.

The memory device is constituted, as mentioned, by RS flip-flop 537. As known, with an RS flip-flop, after its S (set) input undergoes a change in logic state from 1 to 0, the output Q will remain at logic state 1 and output $\overline{Q}$ at logic state 0 so long as a change in logic state from 1 to 0 does not occur at the R (reset) input of the flip-flop.

In the invention a reset pulse (as logic state 1) is generated from the switch 550 which opens the weft insertion clamp which thus "opens" the "window" or interval during which the system is activated to detect the arrival of the weft. Until the weft clamp is opened to permit the weft to be delivered from the weft metering and storage unit, there is no possibility of any weft end arriving and no need for the detection means to remain sensitive. The clamp open switch is opened for only a brief interval and if the pulse applied to the R input of the flip-flop had the same length as this pulse, the flip-flop would not hold the change in state initiated by the change at the S input from logic 1 to logic 0. Therefore, it is necessary to prolong or "stretch" the pulse generated by the clamp open switch so as to continue to apply that pulse as logic 1 at the R input until after the memory unit has been read, namely a few milliseconds subsequent to front dead center of the lay beam, and then the rest pulse terminates, restoring the memory unit to its initial state.

If the output signal from the yarn detector is not interrupted by the arrival of the yarn so that the S input of the flip-flop remains at logic 1, then the $\overline{Q}$ output of the flip-flop remains at logic 1 so that when the timing pulse arrives at AND gate 34, that gate will "see" logic 1 at both its inputs and trigger the triac to activate the loom stop motion. On the other hand, if the yarn does arrive and is sensed by the detector, then the first sensation of such arrival by the detector changes the S input of the flip-flop to logic 0 and reverses the states of its outputs with $\overline{Q}$ changing to a logic 0 output so that when the timing pulse arrives at the AND gate, the gate sees only a single logic 1 input and transmits no activating pulse to trigger the triac so that the loom continues to operate. When the R input held at logic 1 by the extended or stretched pulse from the clamp open switch, the flip-flop remains "inert" to further changes in the logic state of its S input, holding the initial change as a memory until the stretched pulse expires, changing the R input to logic 0 and resetting the flip-flop for the next cycle.

What is claimed is:

1. In a loom in which a weft strand is projected in free flying fashion from one side of a warp shed to the opposite side thereof and including a lay beam rockable between a weft projecting position and a beat up position, a reed fixed on the lay beam for beating up the inserted weft strand into the fell of the fabric being woven when the lay beam moves to the beat up position, and means carried on the lay beam for receiving the free end of said projected weft strand proximate to said opposite side, the improvement comprising: a bracket pivoted on said lay beam for supporting said receiving means on said lay beam for displacement away from and towards the plane of said reed, and lever means operated in response to the rocking motion of said lay beam to pivot said receiving means toward the plane of said reed when said lay moves to beat up position and away from the plane of said reed when said lay moves away from said beat up position.

2. The loom of claim 1 wherein said receiving means engages said strand end with a predetermined tension and including means engaging said strand adjacent said one side of said warp shed with a tension less than said receiving means tension whereby upon said rocking movement an additional length of weft strand sufficient to accommodate the movement of the lay is advanced through said last mentioned tensioning means whereby said strand end remains held in said receiving means during lay beat up.

3. The loom of claim 2 including clamping means associated with said receiving means for engaging said weft strand end with said predetermined tension.

4. Apparatus as set forth in claim 1 including an array of annular elements projecting between spaced apart pairs of adjacent warp threads and arranged in axially aligned relationship, said array of elements being withdrawn during beat up substantially entirely outside the shed and subsequently returned to said projecting relationship therewithin for said weft projection, and said receiving means is supported for displacement to and fro between a position substantially in alignment with the axis of said array for said weft projection and a position substantially coplanar with the reed of the loom during beat up.

5. Apparatus as set forth in claim 1 wherein said receiving means includes means for detecting the receipt of the strand thereby.

6. Apparatus as set forth in claim 5 including means responsive to said detection for generating a control signal in response to arrival of the strand in said receiving means.

7. Apparatus as set forth in claim 6 including means for driving said loom, means operable to deactivate said drive means and means for operating said drive means deactivating means in response to said control signal.

8. Apparatus as set forth in claim 5 wherein said detecting means is a normally energized photodetector spanning the path of said projected weft strand at a point thereon adjacent said shed opposite side, and including means for sensing the interruption of said photodetector by the arriving weft end.

9. Apparatus as set forth in claim 1 wherein said receiving means includes means operable to positively engage the strand thereby.

10. Apparatus as set forth in claim 9 including mounting means supporting said strand engaging means for displacement between inoperative non-engaging position during weft projection and operative engaging position after completion of weft projection.

11. Apparatus as set forth in claim 10 including operating means for said mounting means, said operating means displacing the engaging means between said positions in synchronized relation to the movement of said lay.

12. Apparatus as set forth in claim 1 wherein said receiving means includes a slot-like aperature which is elongated generally parallel to the plane of the reed and means for creating a suction within said slot.

13. Apparatus as set forth in claim 12 wherein said slot-like aperture is provided on its opposite elongated sides with baffles extending laterally perpendicularly of the aperture axis to intercept a weft strand end arriving out of alignment with the slot axis.

14. Apparatus as set forth in claim 1 including means disposed in alignment with the fabric fell proximate the side of the fell corresponding to the opposite shed side for shearing the ends of the weft strand protruding exteriorly of the fabric, said weft end receiving means continuing to receive the corresponding weft end until the same is sheared by said shearing means.

15. In a loom including a normally operative driving means, activatable means for disabling said driving means, means for projecting in substantially free flight an end of a weft strand from one side to an opposite side of a warp shed, and means proximate to said opposite shed side to receive said projected end of said weft strand upon arrival thereat, the improvement comprising: detecting means providing a continuous output in the absence of the detection thereby of the arrival in said receiving means of the weft strand end, memory means receiving said continuous output from said detecting means and providing a corresponding output until said continuous signal is interrupted and thereafter providing no output until reset, means for supplying a timing pulse after a predetermined interval during which arrival of the weft strand end in said receiving means is permissible, disabling means for disabling the normally operative loom driving means, means for receiving the output from said memory means and said timing pulse and causing the activation of said disabling means when both said signal and pulse are simultaneously received thereby, and resetting means for resetting said memory means before the insertion of the next weft strand.

16. Apparatus as set forth in claim 15 wherein said detector means comprises photodetector means spanning the path of said projected weft strand at said opposite shed side and emitting a continuous output signal unless interrupted.

17. In a method of weaving in which the end of a weft strand is projected in substantially free flight from one side to an opposite side of a warp shed, and said projected end of said weft strand is receiving in a receiving zone upon its arrival at said opposite shed side, the steps comprising: generating a detection signal which is continuous until interrupted by the arrival of said weft strand at said receiving zone, delivering said detection signal to a resettable memory which provides an output control signal until said detection signal is interrupted and stores any interruption until reset, establishing a predetermined interval during which arrival of the weft strand at said receiving zone is permissible, at the end of such interval reading such memory and disabling said loom if an output control signal is provided thereby, and resetting the memory after reading the same.

* * * * *